US005615609A

United States Patent [19]

Hill et al.

[11] Patent Number: 5,615,609

[45] Date of Patent: Apr. 1, 1997

[54] SYSTEM AND METHOD FOR CONTROLLING AC MOTOR DRIVEN MULTI-UNIT PRINTING PRESS

[75] Inventors: Alan M. Hill, Topeka; William R. Meeks, Lecompton; Charles L. Van Ness, Lawrence, all of Kans.

[73] Assignee: The Lawrence Paper Company, Lawrence, Kans.

[21] Appl. No.: 518,117

[22] Filed: Aug. 21, 1995

[51] Int. Cl.[6] ..... B41F 5/02

[52] U.S. Cl. ..... 101/183; 101/486

[58] Field of Search ..... 101/181, 216, 101/183, 152, 136–138, 139, 140, 484, 485, 486, 248, 228, 219; 318/49, 50, 66, 68, 69, 77, 41, 51, 721, 715, 799, 806; 226/2, 28–29, 42, 30, 31; 493/30, 34, 321

[56] References Cited

U.S. PATENT DOCUMENTS

| | | | |
|---|---|---|---|
| 2,022,696 | 12/1935 | Tomlin et al. | 101/181 X |
| 3,073,997 | 1/1963 | Tagliasacchi . | |
| 3,701,464 | 10/1972 | Crum . | |
| 4,072,104 | 2/1978 | Schaffer . | |
| 4,437,403 | 3/1984 | Greiner . | |
| 4,527,788 | 7/1985 | Masuda . | |
| 5,127,324 | 7/1992 | Palmatier et al. . | |
| 5,263,413 | 11/1993 | Ikeguchi | 101/183 |
| 5,309,834 | 5/1994 | Koch . | |
| 5,385,091 | 10/1995 | Cuir et al. . | |

OTHER PUBLICATIONS

"SDC–2 Synchronizer Installation and Operation Manual", distributed by Drive Control Systems, 1994.

*Primary Examiner*—J. Reed Fisher

*Attorney, Agent, or Firm*—Shook, Hardy & Bacon L.L.P.

[57] ABSTRACT

A system and method for controlling the registration of a multi-unit printing press for corrugated board materials permits the use of AC motors for driving the printing press. A master AC motor drives a master printing unit, and a master AC driving device is electrically coupled to the master AC motor for controlling the speed of the master AC motor. A master pulse generating device produces output pulses relating to the rotary motion of the master printing unit. A follower AC motor drives a follower printing unit, and a follower AC driving device electrically coupled to the follower AC motor controls the speed of the follower AC motor relative to the master AC motor. A follower pulse generating device produces output pulses relating to the rotary motion of the follower printing unit. A controller is configured to receive the output pulses from the master and follower pulse generating devices, process the master and follower output pulses to produce control commands based on said output pulses, and transmit the control commands to the follower AC driving device so that the speed of the follower AC motor is adjusted relative to the master AC motor as required to maintain synchronized operation between the master and follower AC motors. This configuration maintains precise registration of the multi-unit printing press over the entire range of speeds of the multi-unit printing press and when the multi-unit printing press is temporarily in a non-running state.

12 Claims, 2 Drawing Sheets

SYSTEM AND METHOD FOR CONTROLLING AC MOTOR DRIVEN MULTI-UNIT PRINTING PRESS

FIELD OF THE INVENTION

The present invention relates to printing presses, and more particularly, to a system and method for controlling the registration of multi-unit printing presses for corrugated board material.

BACKGROUND OF THE INVENTION

Existing printing presses for corrugated paper materials (such as cardboard boxes) require the use of separate printing cylinders if more than one color of ink is to be printed on the paper material. For multi-color printing, each cylinder is equipped with a separate printing die corresponding to a particular color. In a conventional multi-unit printing press, the multiple printing cylinders are collectively driven by a single primary motor located, for example, at the die cutting area of the printing press. A line shaft, chain, or gear assembly is operably driven by the primary motor and mechanically coupled to each of the printing cylinders for rotation to conduct the printing operation.

A significant aspect of multi-color printing is the importance of achieving and maintaining precise print registration among each of the multiple printing cylinders as the printing operation is conducted. This precise registration is needed to obtain proper alignment of the multi-color ink patterns on the paper material and avoid overlap or smearing of the colored ink patterns.

The above-described conventional multi-unit printing presses are capable of obtaining the desired precise registration. However, conventional printing presses encounter certain limitations that negatively impact on the ability to continuously and consistently maintain precise registration of the multiple printing units. For example, because the multiple printing cylinders on conventional printing presses are driven via mechanical coupling in the form of a line shaft or similar mechanism in conjunction with gears, these mechanical parts wear over time resulting in degradation of the print registration.

Conventional printing presses also experience problems with print registration when the printing presses require maintenance or repair. Service of the printing cylinders is frequently required to correct problems or for routine maintenance such as cleaning. When service is required, an electric compensator is used to slowly rotate the printing cylinder in either direction to position the cylinder to the area requiring service. Each printing unit on the printing press has an associated manual or electric compensator. After service, the cylinder must be returned as closely as possible to its previous position in an effort to maintain the registration among the cylinders existing before servicing. However, the use of compensators is a relatively inaccurate process for returning the cylinders to proper registration. Consequently, several test runs following service must be performed to return the cylinders to precise registration. This results in waste of both time and materials.

Electronic control systems have been developed for controlling the operation of multi-unit printing presses. For example, U.S. Pat. No. 4,527,788 to Masuda discloses a printer-slotter which has a plurality of rotary members and cylinders each driven independently by a DC servomotor. Each rotary member has a zero-point sensor for detecting a zero-point mark located on the outer periphery of the rotary member. The zero-point mark is detected by the sensor and is used to set the initial phase of each rotary member. A common reference signal is supplied to controllers for all of the units so that the speed and phase of the rotary members of all the units will be controlled according to the reference signal. Thus, the phase relationship between the separate units is maintained and the speed of the servomotors is maintained at the reference speed.

In U.S. Pat. No. 4,437,403 to Greiner, an automatic control system for adjusting register of printing plates in a multi-color printing press is disclosed. In this patent, register marks are copied on the printing plates when the plates are manufactured. Photoelectric scanners sense the register marks on the printing plates to determine the relative positions of the printing plates. The relative positions are compared and adjusted with servomotors so that all of the printing cylinders are in register with one another. The position of the printing plate having the least deviation from the corresponding zero position for a plate cylinder is chosen as the reference position to which the positions of the other printing plates are compared. The goal of this patent is to automatically align the plates on the plate cylinders in exact registration before printing starts to avoid preparation time and waste.

An important drawback of the above-described control systems is their significant expense relative to conventional printing presses. Because these control systems utilize DC motors and/or servomotors and DC drives, the expense of these components for application on a multi-unit printing press is considerable.

SUMMARY OF THE INVENTION

In view of the foregoing, it is a primary object of the present invention to provide a system and method for precisely controlling the registration of a multi-unit printing press for corrugated board material in a more cost-effective manner than has heretofore been available.

Another important object of this invention is to provide a control system and method for a multi-unit printing press that maintains precise registration thereby allowing the use of more printing units on the printing press to provide more ink colors.

A further object of this invention is to provide a control system and method for a multi-unit printing press that maintains precise registration but eliminates the need for line shafts, chains or other mechanical coupling structures used to collectively drive the printing cylinders on conventional multi-unit printing presses.

Still another object of this invention is to provide a control system and method for a multi-unit printing press that maintains precise registration over the entire operating speed range of the printing press.

Another object of this invention is to provide a control system and method for a multi-unit printing press that maintains precise registration while the printing press is temporarily in a non-running state such as for servicing or repair.

A related object of this invention is to provide a control system and method for a multi-unit printing press that eliminates the need for electric compensators used on conventional imprinting presses.

An additional object of this invention is to provide a control system and method for a multi-unit printing press that eliminates the need for test runs to adjust registration following servicing, thereby saving time and materials.

These and other important aims and objectives are accomplished with the system for controlling the registration of a multi-unit printing press according to the present invention. The control system includes a master AC motor which drives a master printing unit, and a master AC driving device electrically coupled to the master AC motor for controlling the speed of the master AC motor and permitting the master AC motor to be operated at any selected speed within a range of speeds. A master pulse generating device produces output pulses relating to the rotary motion of the master printing unit. The system also includes a follower AC motor for driving a follower printing unit, and a follower AC driving device electrically coupled to the follower AC motor for controlling the speed of the follower AC motor relative to the master AC motor and permitting the follower AC motor to be operated at any selected speed within a range of speeds. A follower pulse generating device produces output pulses relating to the rotary motion of the follower printing unit. A controller is configured to receive the output pulses from the master and follower pulse generating devices, process the master and follower output pulses to produce control commands based on said output pulses, and transmit the control commands to the follower AC driving device so that the speed of the follower AC motor is adjusted relative to the master AC motor as required to maintain synchronized operation between the master and follower AC motors. This configuration maintains precise registration of the multi-unit printing press over the entire range of speeds of the multi-unit printing press and when the multi-unit printing press is temporarily in a non-running state.

BRIEF DESCRIPTION OF THE DRAWINGS

The various aspects of the invention are described in detail below, with reference to the drawings, in which.

DETAILED DESCRIPTION OF THE PREFERRED EMBODIMENT

Figure 1:
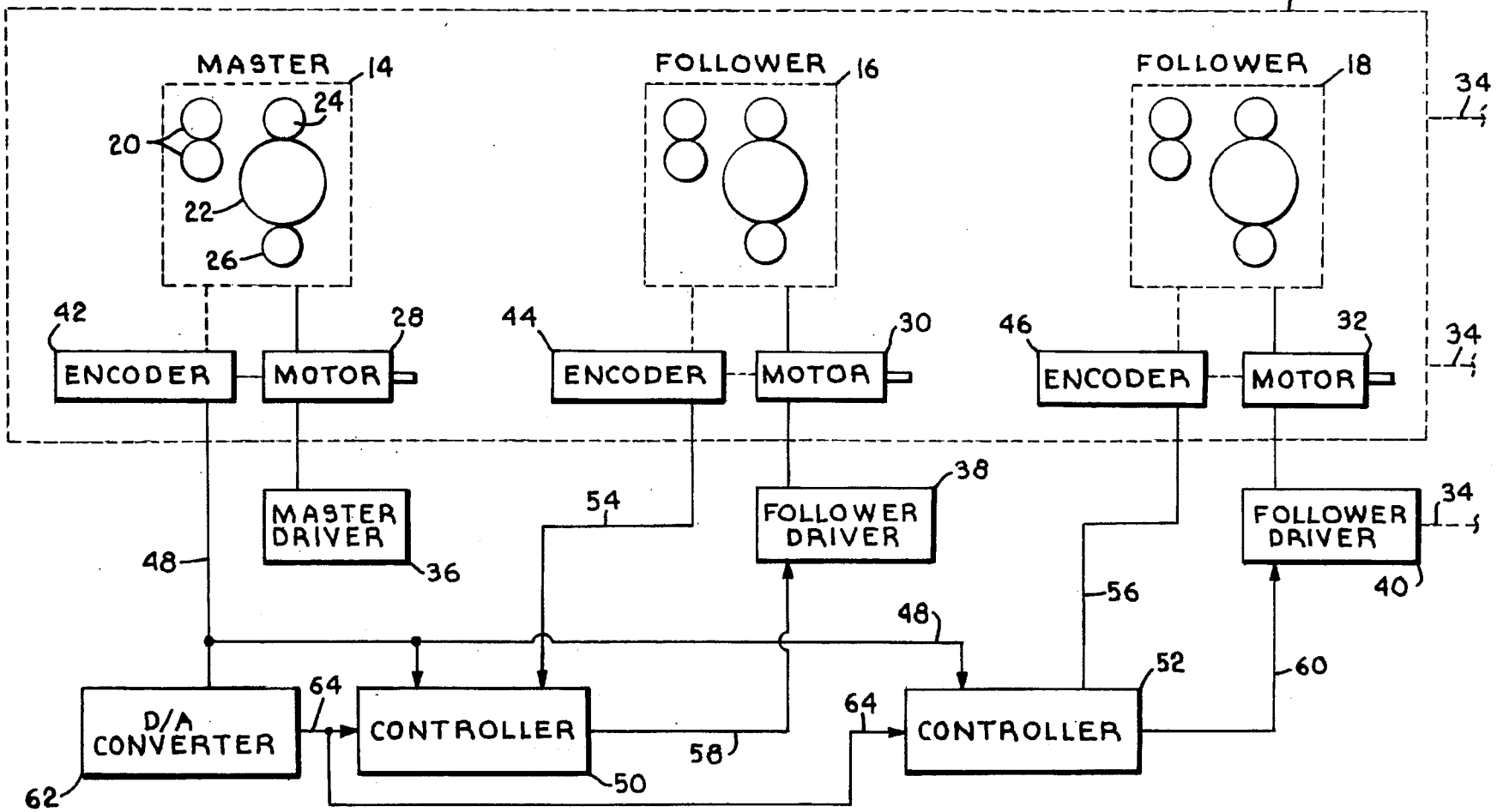
FIG. 1 is a block diagram illustrating the control system for a multi-unit printing press according to the present invention.

A system for controlling the registration of a multi-unit printing press for corrugated board material is broadly designated in FIG. 1 by the reference numeral 10. A multi-unit printing press 12 includes a plurality of individual printing units. Specifically, FIG. 1 shows a master printing unit 14 along with follower printing units 16 and 18. Each printing unit includes a plurality of rotary members that are operably configured to conduct the printing operation on the corrugated board material. FIG. 1 generally illustrates that each of the individual printing units includes a pair of pull rolls 20, a printing cylinder 22, a press roll 24, and an anilox roll 26 for ink feeding. It will be appreciated by those skilled in the art that the printing units as illustrated in FIG. 1 only very generally represent the components of a printing unit on a multi-unit printing press.

As discussed previously, in conventional multi-unit printing presses the multiple printing cylinders are collectively driven by a single primary motor which drives a line shaft, chain, or gear assembly mechanically coupled to each of the printing cylinders for rotation in order to conduct the printing operation. Although conventional multi-unit printing presses are capable of obtaining the precise registration required for proper alignment of the multi-color ink patterns on the paper material, it is difficult to continuously maintain precise registration of the multiple printing units due to wear of the mechanical coupling structure. Consequently, this wear results in degradation of the print registration.

In accordance with the present invention, the printing units 14, 16 and 18 are mechanically independent and are respectively driven by individual AC motors 28, 30 and 32. Importantly, control system 10 of the present invention permits the use of AC motors for driving the printing units of printing press 12. The ability to utilize AC motors for a multi-unit printing press is particularly desirable because AC motors are considerably less expensive than DC motors or servomotors of the type used in the control systems for multi-unit printing presses discussed previously.

Typically, standard AC induction motors are not known for the capability of speed control over a wide range. Rather, AC motors normally are used as constant speed drives. Variations of conventional AC induction motors have been designed for the express purpose of improved speed control. However, neither standard AC motors nor specially designed AC motors have heretofore been practical for use in driving a multi-unit printing press in the absence of mechanical coupling structures such as line shafts, gears, etc. However, control system 10 of the present invention provides the capability of using standard AC motors for achieving the precise print registration required for multi-color ink printing.

AC motors 28, 30 and 32 in the illustrated embodiment are squirrel cage wound rotor AC induction motors. More specifically, master AC motor 28 is a 15 HP motor, and follower AC motors 30 and 32 are 10 HP motors. It should be noted that for dual-color ink printing, follower printing unit 18 could be replaced with a die cutter. In this instance, a 20 HP motor would be required for motor 32.

Control system 10 of the present invention achieves the precise registration necessary for multi-color printing by employing a master/follower relationship. In other words, follower printing units 16 and 18 are driven at a speed synchronously related to the speed of master printing unit 14. The master/follower relationship according to the present invention IO provides synchronized operation between the master and follower AC motors so that precise registration of multi-unit printing press 12 can be maintained over the entire operating range of the printing press. Specifically, the present invention is capable of maintaining the print registration within 0.003 inches over the entire operating speed range of printing press 12. Such precise registration obtained with the use of AC motors is a significant accomplishment that has not been achieved with existing printing presses. In keeping with the present invention, the ability to maintain such precise registration enables the use of additional printing units so that more ink colors can be provided with printing press 12. This capability is illustrated in FIG. 1 by dashed lines 34.

The individual AC motors 28, 30 and 32 are controlled with individually corresponding drivers. As shown in FIG. 1, a master driver 36 and two follower drivers 38 and 40 are electrically coupled to their corresponding AC motors in order to control the speed of the AC motors. Drivers 36, 38 and 40 permit the AC motors to be operated at any selected speed within a range of speeds of the AC motors. In the preferred embodiment, the master and follower drivers comprise AC inverters. A suitable AC inverter for purposes of the present invention is the "E-TRAC" AC inverter provided by T. B. Wood's Sons Company of Chambersburg, Pa.

The primary operation of AC inverters is to accept fixed voltage and frequency from a power source and convert this power into variable voltage and frequency to control the speed operation of a polyphase AC induction motor of the kind used in the present invention. In control system 10, master driver 36 is provided with a standard reference voltage. In order to maintain synchronized operation between master printing unit 14 and follower printing units 16 and 18, the voltage input received by follower drivers 38 and 40 is derived from the rotary motion of master printing unit 14 as explained below.

Control system 10 includes a master encoder 42 for producing output pulses relating to the rotary motion of master printing unit 14. Control system 10 also includes a follower encoder 44 and a follower encoder 46 for producing output pulses relating to the rotary motion of follower printing units 16 and 18, respectively. Encoders 42, 44 and 46 are quadrature NPN encoders having an encoder resolution of 1,000 pulses per resolution. Generally, encoders are pulse generating devices that sense the position and motion of a rotary member and produce a digital signal which can be interpreted by a system controller or microprocessor. Specifically, the encoders of the present invention are optical rotary encoders that sense the movement or position of drive train components rotating about an axis. Optical rotary encoders include a light source (e.g., LEDs) used to pass light through slots in a rotating code wheel. The light is detected by a photoelectric diode mounted opposite the light source. A signal processor accepts the signals from the photoelectric diode and converts them into a binary or another code signal. These pulses are counted to obtain the angular position of the sensed rotating member.

In the illustrated embodiment of the present invention, encoder 42 is electrically connected to one of the rotary members of master printing unit 14, specifically one of the pull rolls 20, in order to detect the rotary motion of printing unit 14. In a similar manner, encoders 44 and 46 are electrically connected to one of the pull rolls 20 of follower printing units 16 and 18, respectively. Connecting the encoders to one of the rotary members of the respective printing units is advantageous because it provides more direct monitoring of the actual rotary operation of the printing units. It should be noted that the encoders could be electrically connected directly to the AC motors rather than to one of the rolls on the printing units. However, some accuracy may be lost under this arrangement because mechanical parts such as a gear box, a belt, and pulleys exist between the motor and the printing cylinder. These mechanical parts may cause backlash or slippage which could produce inaccuracies in the encoder pulses.

As shown in FIG. 1, the output pulses from master encoder 42 are transmitted via line 48 to controllers 50 and 52. Controller 50 also receives the encoder output pulses from follower encoder 44 via line 54, and controller 52 receives output pulses from follower encoder 46 via line 56. As explained in more detail in connection with FIG. 2, controllers 50 and 52 are configured to receive the output pulses from the master and follower encoders and process these output pulses to produce speed commands for follower drivers 38 and 40. In FIG. 1, it can be seen that the speed control command from controller 50 is transmitted to follower driver 38 via line 58, and the speed control command from controller 52 is transmitted to follower driver 40 via line 60. These speed control commands are provided to follower drivers 38 and 40 in order to adjust the speed of follower AC motors 30 and 32 relative to master AC motor 28 as required to maintain synchronized operation between the master and follower printing units so that precise registration of printing press 12 can be maintained over the entire operating speed range of printing press 12. Moreover, as discussed further below, this precise registration can be maintained even when printing press 12 is temporarily in a non-running state such as for servicing or repair. FIG. 1 also shows that controllers 50 and 52 receive a signal 64 from digital/analog converter 62 which is used to convert the digital output signal from master encoder 42 into an analog voltage signal.

In addition to the significant advantages discussed above relating to the elimination of mechanical coupling structures and the ability to maintain precise print registration with AC motors over the entire operating speed range of the printing press, control system 10 of the present invention provides other advantages. Namely, control system 10 is capable of maintaining precise registration of the multi-unit printing press when the printing press is temporarily in a non-running state such as for repair and servicing. As explained previously, manual or electric compensators are used in conventional printing presses to rotate the printing cylinders in either direction to position the cylinders to the specific area requiring service. Each printing unit requires an individual compensator in order to perform this function. These compensators are relatively expensive equipment, and also are relatively imprecise for returning the cylinders to proper registration. Consequently, several test runs following service or repair must be performed to return the cylinders to precise registration. However, in keeping with the present invention, control system 10 completely eliminates the need for compensators thereby reducing the overall cost of the printing press. Moreover, because the print registration is maintained while the printing press is being serviced, there is little (if any) need for test runs typically required to return conventional printing presses to precise registration.

It was previously noted that AC inverters are used for the master and follower drivers in control system 10. In an alternative implementation of the present invention, flux vector controllers can be used for the master and follower drivers. Vector control allows independent control of the field flux and rotor current of an induction motor to achieve linear torque characteristics like those of DC motors. The motor control regulates the instantaneous magnitude and phase of the stator currents or voltages in order to develop a linear relationship between torque and slip frequency. Flux vector controllers require feedback to identify the speed and position of the corresponding motor shaft. In this instance, the feedback device is an encoder mounted directly to the motor. The direct control of current and shaft position permits a flux vector controller to rotate the motor shaft to any position and hold it there with full rated torque. A suitable flux vector drive for use in the present invention is the Series 18H AC Flux Vector Controller from Baldor Electric Company of Ft. Smith, Ark.

In the illustrated implementation, standard AC inverters are used for master driver 36 and follower drivers 38 and 40. Several parameters relating to the AC inverters require configuration to achieve proper synchronization of the master and follower printing units. Table 1 below sets forth the types of parameters and the parameter values for a 15 HP master printing unit 14, a 10 HP follower printing unit 16, and a 20 HP die cutter used in place of printing unit 18.

TABLE 1

| Parameter Description | 15 HP (Master) Feeder | 10 HP (Follower) 2nd Printer | 20 HP (Follower) Die Cutter |
|---|---|---|---|
| Inverter Model Number | 40150 | 10100 | 40200 |
| Software Revision | 3.1 | 3.0 | 2.9 |
| Inverter Rated Current | 24 | 14 | 27 |
| Repair Date Code | 0 | 0 | 0 |
| Last Fault | 80 | 209 | 160 |
| 2nd Fault | 0 | 050 | 189 |
| 1st Fault | 0 | 209 | 069 |
| Motor Output Frequency | 0 | 0 | 0 |
| Motor Output Voltage | 0 | 0 | 6 |
| Motor Output Current | 0 | 0 | 0 |
| Drive Load | 0 | 0 | 0 |
| Load Torque | 0 | 0 | 0 |
| Drive Temperature | 30 | 28 | 30 |
| Total Running Hours | 363 | 381 | 891 |
| Operating Hours | 920 | 911 | 2344 |
| Stator Frequency | 0 | 0 | 0 |
| Input Mode | 3 | 3 | 4 |
| Reference Selector | 0 | 0 | 0 |
| Torque Limit Ref. Selector | 0 | 0 | 0 |
| Minimum Frequency | 5 | 0 | 0 |
| Maximum Frequency | 60 | 55 | 90 |
| Preset Frequency #2 (JOG) | 5 | 5 | 5 |
| Preset Frequency #3 | 20 | 20 | 20 |
| Preset Frequency #4 | 40 | 40 | 40 |
| Preset Frequency #5 | 60 | 60 | 60 |
| Preset Frequency #6 | 0 | 0 | 0 |
| Preset Frequency #7 | 0 | 0 | 0 |
| Min. Frequency in Torque Limit | 10 | 10 | 10 |
| Ramp Selector | 0 | 0 | 0 |
| Acceleration Ramp #1 | 30 | .5 | .5 |
| Deceleration Ramp #1 | 3 | .5 | .5 |
| Acceleration Ramp #2 | 1 | .5 | 1 |
| Deceleration Ramp #2 | 1 | .5 | 1 |
| Decel. Ramp in Torque Limit | 1 | 1 | 1 |
| DC Brake Time | .2 | .2 | .2 |
| DC Brake Voltage | 4.01 | 4 | 4 |
| V/Hz Characteristic Selector | 0 | 1 | 1 |
| Torque Boost | 6 | 6 | 6 |
| V/Hz Knee Frequency | 60 | 60 | 60 |
| Skip Freg. Hysteresis Band | 1 | 1 | 1 |
| Skip Frequency #1 | 0 | 0 | 0 |
| Skip Frequency #2 | 0 | 0 | 0 |
| Skip Frequency #3 | 0 | 0 | 0 |
| Skip Frequency #4 | 0 | 0 | 0 |
| Rated Motor Voltage | 460 | 460 | 460 |
| Preset Load Torq. Limit FWD | 150 | 150 | 150 |
| Preset Load Torq. Limit REV | 150 | 150 | 150 |
| Preset Regen. Torque Limit FWD | 80 | 80 | 80 |
| Preset Regen. Torque Limit REV | 80 | 80 | 80 |
| Slip Compensation | 0 | 0 | 0 |
| Current Stability Adjustment | 2 | 2 | 2 |
| Timed Overload Trip Point | 0 | 88 | 88 |
| Trip Restart Number | 0 | 0 | 0 |
| Restart Time Delay | 0 | 0 | 0 |
| Analog Meter Output | 1 | 1 | 1 |
| Auxiliary Output #1 | 5 | 6 | 2 |
| Auxiliary Output #2 | 3 | 3 | 3 |
| Auxiliary Output #3 | 7 | 7 | 7 |
| Auxiliary Relay (Fault) | 5 | 3 | 5 |
| Special Program Number | 32 | 0 | 40 |
| Inverter Start Options | 0 | 0 | 0 |
| Pulse-Width-Modulation Selector | 0 | 0 | 0 |
| Display Option Pull Setting | 0 | 0 | 0 |
| Display Option Units Setting | RPMI | RPMI | RPMI |
| Display Text Language | 0 | 0 | 0 |

It should also be noted that in addition to the above parameters, the implementation illustrated herein requires the use of dynamic breaking in connection with the master and follower drivers. Generally, dynamic breaking is achieved by altering the connections to the motor with or without the,aid of an auxiliary power source. The motor acts like a generator so that the kinetic energy of the motor and the driven load can be used to exert a retarding force to slow the forward rotation of the motor. External dynamic brake assemblies increase the capacity of the AC inverters to absorb the regenerated energy from a motor during rapid deceleration of overhauling loads. The use of a die cutter is such an overhauling load that requires additional dynamic braking. In a specific implementation of the present invention, the 20 HP die cutter requires dynamic breaking capacity of 30 HP.

Figure 2:
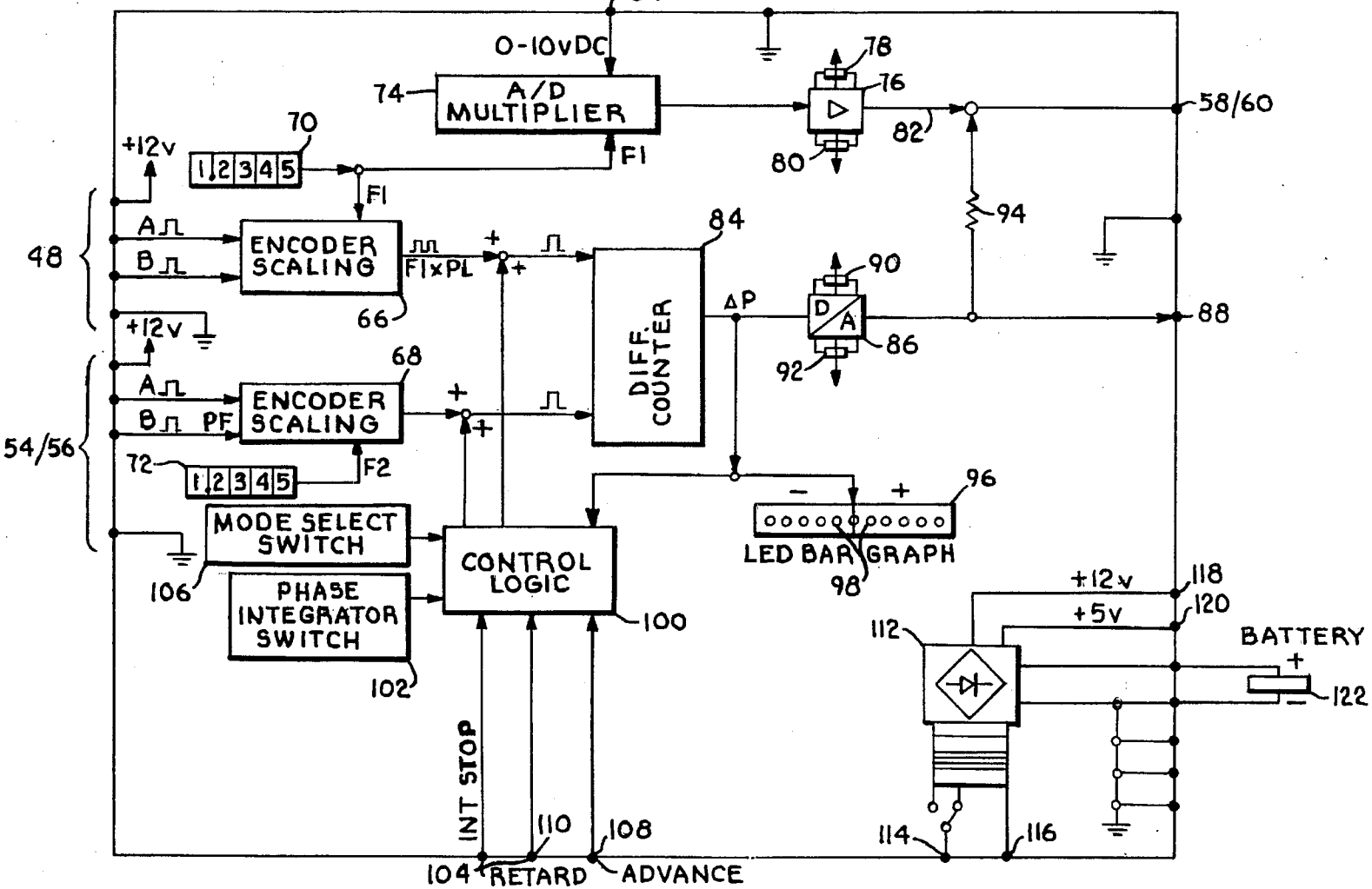
FIG. 2 is a schematic diagram illustrating the details of the controller shown in FIG. 1.

FIG. 2 schematically illustrates in greater detail the components of controllers 50 and 52 shown in FIG. 1. As explained previously, controllers 50 and 52 receive the output pulses from the master and follower encoders and process these pulses to produce speed control commands. These speed control commands are transmitted to follower drivers 38 and 40 in order to maintain synchronized operation between master printing unit 14 and follower units 16 and 18. Each pulse from the corresponding encoders represents a given number of degrees of rotation of the monitored rotary member (either the pull roll or motor). Generally, the incoming encoder pulses are counted by a differential counter included in controllers 50 and 52. The count difference is continuously calculated digitally. When a deviation exists between the master encoder pulses and the follower encoder pulses, this difference is detected and converted to an analog correction signal. This correction signal is then combined with the reference signal provided to the follower drivers in order to accelerate or decelerate the follower motors so that the deviation between the encoder pulses becomes zero.

In FIG. 2, the output pulses from master encoder 42 are designated by reference numeral 48. As noted previously, the encoders are quadrature encoders and thus have dual inputs 48-A and 48-B. A +12 V source connection and a ground connection are included which can be used to power encoder 42. Similarly, the output pulses from follower encoders 44 and 46 are designated by reference numerals 54/56 which include dual inputs 54/56-A and 54/56-B. Additionally, the output pulses from master encoder 42 converted to analog form by converter 62 are shown in FIG. 2 as input 64. This input is an analog input voltage ranging between 0 and 10 volts DC.

The digital inputs from the master and follower encoders are received by encoder scaling units 66 and 68. An encoder scaling factor can be set via switches 70 (F1) and 72 (F2). The scaling factor allows the speed ratio between the master and follower drivers to be set to a particular resolution to compensate, if necessary, for plant specific conditions such as differences in encoder resolution, differences in shaft sizes on synchronized machinery, etc. In the specific implementation of the present invention, the scaling ratio between the master and follower drivers is 2:1 such that the F1 scaling factor is set at 2.0000 and the F2 factor is set at 1.0000.

The F1 scaling factor is also provided to a combined analog/digital multiplier circuit 74 which converts the analog master voltage signal to digital form and scales this signal in relation to F1. The output from A/D multiplier circuit 74 is provided to an amplifier circuit 76 which includes an output gain adjustment potentiometer 78 and an output offset potentiometer 80. The signal from circuit 76 thus results in an output voltage 82 which is represented by the formula: Output Voltage=Output Gain×Master Voltage×F1. Output voltage 82 is then used as the reference voltage for follower drivers 38 and 40 in order to provide analog synchronization between the master and follower printing units.

To provide digital synchronization, the scaled encoder pulse signals from the master and follower encoders are compared in a differential counter 84. A difference signal ΔP produced by differential counter 84 is converted to analog form via a D/A converter 86. The output from D/A converter 86 is an analog error signal 88 which essentially is a correction voltage for follower drivers 38 and 40. A trim potentiometer 90 is coupled to converter 86 for adjusting the correction gain between 1 mV per increment to 100 mV per increment. Additionally, the offset of the correction voltage output 88 can be adjusted separately via correction offset potentiometer 92.

Depending on the particular application, two output voltages can be supplied to the follower drivers: output voltage 82 and correction voltage 88. However, it normally is preferable to provide only one reference voltage to follower drivers 38 and 40. For this purpose, the correction voltage 88 can be summed with the output voltage 82 from circuit 76 via a resistor 94 to supply a single output voltage to follower drivers 38 and 40. This output voltage is designated in the figures by reference 58/60.

As shown in FIG. 2, the output signal ΔP from the differential counter is also supplied to an LED bar graph 96 included with controllers 50 and 52. The LED bar graph display provides a visual indication of the state of the internal pulse differential level, i.e., it provides an indication of the correction voltage level 88. When no error is present, two green LEDs designated by reference numeral 98 are illuminated. In all other cases in which a positive or negative correction voltage is produced, only one LED is illuminated generally indicating the magnitude of the correction voltage by its distance from center. In other words, when the LED display moves to the right on LED bar graph 96, a positive correction voltage is produced in order to increase the speed of the particular follower driver. Similarly, when the display on LED bar graph 96 moves to the left, a negative correction voltage is produced in order to decrease the speed of the follower driver and its associated motor.

FIG. 2 also shows that the AP signal is input to phase and index control logic 100. Control logic 100 includes circuitry to perform phase integration and phase adjustment as required depending on the particular application. As can be seen, a phase integrator switch 102 is connected to control logic 100. The phase integrator switch 102 on the controller of FIG. 2 is a ten-position switch that adds small additional corrections until the phase difference is returned to zero. Phase integrator switch 102 is primarily used to boost the correction voltage to help it compensate for non-linearities in the associated drivers. In the illustrated embodiment, no phase integration is necessary to provide the precise print registration for printing press 12. Thus, the phase integrator switch is set at 0 for fully proportional operation. Additionally, phase integrator switch 102 is disabled by connecting terminal 104 (INT STOP) to common.

A mode select switch 106 also provides an input to control logic 100. Mode select switch 106 allows the controllers to operate with phase adjustment capability. This allows a user to adjust the position of the respective printing units by advancing or retarding the follower units with respect to the master unit. Essentially, this phase adjustment provides an electronic running register which enables users to adjust the print registration of printing press 12 while the printing press is in operation. The ability to provide electronic running registration is highly desirable since it replaces "mechanical" running registration which typically requires an extra set of gears in the drive train to turn one of the print cylinders without turning the rest of the drive train. Thus, the electronic running register of the present invention eliminates a motor and gears typically required to perform mechanical running registration. in conventional multi-unit printing presses.

In order to advance or retard one of the follower printing units 16 and 18 with respect to master printing unit 14, an "advance" terminal 108 and a "retard" terminal 110 are provided which supply inputs to control logic 100. Terminals 108 and 110 are external contacts that allow users to add artificial pulses to the follower count register or the master count register in counter 84 in order to change or adjust the angular position of the follower unit with respect to the master unit. Specifically, an artificial count can be added to the master count register by connecting terminal 108 to common in order to move the follower unit position forward with regard to the master printing unit. Similarly, an artificial count can be added to the follower count register by connecting terminal 110 to common in order to move the follower position backward with regard to the master. The speed at which the adjustment occurs is selected through mode select switch 106 which is a five-position switch. In the illustrated embodiment, the mode select switch is set in position two (2) which is equivalent to a speed adjustment of 14 encoder pulses per second.

The controller of the present invention also includes a power supply circuit 112 which accepts a neutral (110 V or 220 V) voltage at terminal 114 or a line (110 V or 220 V) input voltage at terminal 116. Supply circuit 112 produces a +12 V output at terminal 118 and a +5 V output at terminal 120. Additionally, a battery 122 is connected to power supply circuit 112 to provide a battery backup option to supply power in case of temporary power loss.

In order to initially set the analog synchronization discussed above, the master input signal is connected to terminal 64 and the follower output signal is connected to the appropriate follower drivers at terminal 58/60. Correction gain potentiometer 90 is set at a fully counter-clockwise position to switch off the correction voltage 88. The scaling values for F1 and F2 are entered and then the master and follower drives are enabled. LED bar graph 96 is then examined to determine whether the particular follower printing unit is moving too slow or too fast with respect to the master printing unit. Because AC motors are used with AC driving devices, synchronization is achieved by properly adjusting the maximum frequency setting on the AC drivers. The particular maximum frequency settings set forth in Table 1 above were determined to be necessary to achieve precise print registration according to the present invention. Additionally, the output gain potentiometer 78 can be used for fine tuning after obtaining synchronization as close as possible by setting the maximum frequency settings of the follower drivers.

To complete overall synchronization of the master and follower printing units, digital synchronization is employed by utilizing the correction signal 88. Potentiometer 90 is adjusted in the clockwise direction to increase the magnitude of the correction signal. The system will achieve more precise synchronization by providing a stronger correction signal. However, if the correction signal is too strong, improper motion or oscillation of the follower units can result. Typically, the position of potentiometer 90 should be set five turns from the zero position.

As is evident from the foregoing description, the control system of the present invention precisely controls the registration of a multi-unit printing press in a more cost-effective manner than existing or conventional printing presses. The cost-effective aspect of the present invention primarily involves the ability to use AC motors and AC drive devices in connection with the multi-unit printing press. The present invention maintains precise registration over the entire operating speed range of the printing press and also when the printing press is temporarily in a non-running state such as for servicing or repair. Thus, the invention allows the use of more printing units on the printing press to provide more ink colors.

Having described the invention, we claim:

1. A system for controlling the registration of a multi-unit printing press for corrugated board material that permits the use of AC motors for driving the printing press, the multi-unit printing press having a master printing unit and at least one follower printing unit, the printing units each having a plurality of rotary members operably configured for conducting the printing operation, the system comprising:

a master AC motor for driving the master printing unit;

a master AC driving device electrically coupled to the master AC motor for controlling the speed of the master AC motor and permitting the master AC motor to be operated at any selected speed within a range of speeds;

a master pulse generating device for producing output pulses relating to the rotary motion of the master printing unit;

a follower AC motor for driving the follower printing unit;

a follower AC driving device electrically coupled to the follower AC motor for controlling the speed of the follower AC motor relative to the master AC motor and permitting the follower AC motor to be operated at any selected speed within a range of speeds;

a follower pulse generating device for producing output pulses relating to the rotary motion of the follower printing unit; and a controller configured to receive the output pulses from the master and follower pulse generating devices, process the master and follower output pulses to produce control commands based on said output pulses, and transmit the control commands to the follower AC driving device for adjusting the speed of the follower AC motor relative to the master AC motor as required to maintain synchronized operation between the master and follower AC motors so that precise registration of the multi-unit printing press is maintained over the entire range of speeds of the multi-unit printing press and when the multi-unit printing press is temporarily in a non-running state.

2. The system as defined in claim 1 wherein the multi-unit printing press includes a plurality of follower printing units, and wherein each of the follower printing units has associated therewith an individually corresponding follower AC motor, follower AC driving device, follower pulse generating device, and controller respectively configured to maintain synchronized operation between the master AC motor and each of the follower AC motors so that precise registration of the multi-unit printing press is maintained over the entire range of speeds of the multi-unit printing press and when the multi-unit printing press is temporarily in a non-running state.

3. The system as defined in claim 2 wherein the precise registration of the multi-unit printing press is maintained within 0.003 inches over the entire range of speeds of the printing press and when the printing press is temporarily in a non-running state.

4. The system as defined in claim 1 wherein the respective pulse generating devices comprise rotary shaft encoders for producing the output pulses relating to the rotary motion of the respective printing units.

5. The system as defined in claim 4 wherein the master and follower rotary shaft encoders are electrically connected respectively to one of the rotary members of the respective master and follower printing units to monitor the rotation of the rotary members and produce the output pulses relating to the rotary motion of the respective printing units.

6. The system as defined in claim 1 wherein the controller compares the master output pulses against the follower output pulses and produces the control commands for adjusting the speed of the follower AC motor when their is a deviation between the compared output pulses.

7. The system as defined in claim 1 wherein the controller includes means for electronically adjusting the registration of the printing units with respect to one another while the printing press is in operation.

8. A method for controlling the registration of a multi-unit printing press for corrugated board material that allows the use of AC motors for driving the printing press, the multi-unit printing press having a master printing unit and at least one follower printing unit, the printing units each having a plurality of rotary members operably configured for conducting the printing operation, the method comprising:

driving the respective master and follower printing units with separate AC motors;

controlling the speed of each of the AC motors with separate AC driving devices to permit the AC motors to be operated at any selected speed within a range of speeds;

monitoring the rotation of the master and follower printing units and producing master and follower output signals relating to the rotary motion of each of the respective printing units;

processing the master and follower output signals and producing control signals based on said processing;

communicating the control signals to the follower AC driving device; and automatically adjusting the speed of the follower AC motor relative to the master AC motor based on the control signals as required to maintain synchronized operation between the master AC motor and the follower AC motor so that precise registration of the multi-unit printing press is maintained over the entire range of speeds of the multi-unit printing press and when the multi-unit printing press is temporarily in a non-running state.

9. The method as defined in claim 8 wherein the multi-unit printing press includes a plurality of follower printing units, and wherein synchronized operation between the master AC motor and each of the follower AC motors is maintained so that precise registration of the multi-unit printing press is maintained over the entire range of speeds of the multi-unit printing press and when the multi-unit printing press is temporarily in a non-running state.

10. The method as defined in claim 9 wherein the precise registration of the multi-unit printing press is maintained within 0.003 inches over the entire operating speed range of the printing press and when the printing press is temporarily in a non-running state.

11. The method as defined in claim 10 wherein the master and follower output signals are produced respectively by rotary shaft encoders electrically connected respectively to one of the rotary members of each of the master and follower printing units.

12. The method as defined in claim 8 further comprising selectively electronically adjusting the registration of the printing units with respect to one another while the printing press is in operation.

* * * * *

UNITED STATES PATENT AND TRADEMARK OFFICE

CERTIFICATE OF CORRECTION

PATENT NO. : 5,615,609

DATED : April 1, 1997

INVENTOR(S) : Alan M. Hill, William R Meeks and Charles L. Van Ness

It is certified that error appears in the above-indentified patent and that said Letters Patent is hereby corrected as shown below:

In column 7, line 4, delete "10100" and insert --40100--.

Signed and Sealed this

Thirtieth Day of June, 1998

*Attest:*

*Attesting Officer*

BRUCE LEHMAN

*Commissioner of Patents and Trademarks*